US010607593B1

(12) United States Patent
Valeri et al.

(10) Patent No.: US 10,607,593 B1
(45) Date of Patent: Mar. 31, 2020

(54) METHOD AND APPARATUS FOR MITIGATION OF NOISE GENERATED BY TWO TORQUE MACHINES

(71) Applicant: GM Global Technology Operations LLC, Detroit, MI (US)

(72) Inventors: Frank C. Valeri, Novi, MI (US); James T. Lagodzinski, Royal Oak, MI (US); Timothy J. Roggenkamp, Brighton, MI (US); Craig R. Towalski, Howell, MI (US); William Seldon, Highland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 16/160,125

(22) Filed: Oct. 15, 2018

(51) Int. Cl.
*G10K 11/178* (2006.01)

(52) U.S. Cl.
CPC ..... *G10K 11/1781* (2018.01); *G10K 11/1785* (2018.01); *G10K 2210/1282* (2013.01); *G10K 2210/3214* (2013.01); *G10K 2210/3216* (2013.01)

(58) Field of Classification Search
CPC ..... G10K 11/1781; G10K 11/1785; G10K 2210/1282; G10K 2210/3214; G10K 2210/3216
USPC ..... 381/71.4
See application file for complete search history.

(56) References Cited

U.S. PATENT DOCUMENTS 8,594,870 B2 * 11/2013 Asahara ..... B60L 3/00 701/22
2004/0247137 A1 * 12/2004 Inoue ..... G10K 11/178 381/71.4

* cited by examiner

*Primary Examiner* — Vivian C Chin
*Assistant Examiner* — Douglas J Suthers
(74) *Attorney, Agent, or Firm* — Quinn IP Law

(57) ABSTRACT

A vehicle and an associated method for augmenting audible sound generated in a passenger compartment by operation of first and second torque machines are described. The passenger compartment includes an audio speaker that is operably controlled by a controller that is also is in communication with the first and second torque machines. The controller includes an instruction set that is executable to determine first parameters associated with audible sound generated by operation of the first torque machine and determine second parameters associated with audible sound generated by operation of the second torque machine. A desired audible sound in the passenger compartment is determined. The audio speaker is controlled to generate a correction tone based upon the first parameters, the second parameters and the desired audible sound in the passenger compartment.

16 Claims, 4 Drawing Sheets

METHOD AND APPARATUS FOR MITIGATION OF NOISE GENERATED BY TWO TORQUE MACHINES

INTRODUCTION

Vehicles equipped with multiple electric machines, especially those having similar functions, may generate beating, booming, and modulation tonal noises. These noises may be caused by the interactions in tonal sinewaves emitted from each drive unit that combine in the vehicle cabin. Such noises may be objectionable to passengers. One non-limiting example of multiple on-vehicle electric machines having similar functions include electric vehicle drive units that generate tractive torque for propulsion.

SUMMARY

A vehicle and an associated method for augmenting audible sound generated in a passenger compartment by operation of first and second torque machines are described. The passenger compartment includes an audio speaker that is operably controlled by a controller that is also is in communication with the first and second torque machines. The controller includes an instruction set that is executable to determine first parameters associated with a first audible sound generated by operation of the first torque machine and determine second parameters associated with a second audible sound generated by operation of the second torque machine. A desired audible sound in the passenger compartment is determined. The audio speaker is controlled to generate a correction tone based upon the first parameters, the second parameters and the desired audible sound in the passenger compartment.

An aspect of the disclosure includes the first parameters associated with audible sound being generated by operation of the first torque machine including a first frequency, a first amplitude and a first phase associated with the audible sound, and the second parameters associated with audible sound being generated by operation of the second torque machine including a second frequency, a second amplitude and a second phase associated with the audible sound.

Another aspect of the disclosure includes determining a difference between the first frequency associated with the first torque machine and the second frequency associated with the second torque machine, and controlling the audio speaker to generate the correction tone based upon the first parameters, the second parameters and the desired audible sound in the passenger compartment only when the difference between the first and second frequencies is less than a threshold.

Another aspect of the disclosure includes determining a difference between the first amplitude associated with the first torque machine and the second amplitude associated with the second torque machine, and controlling the audio speaker to generate the correction tone based upon the first parameters, the second parameters and the desired audible sound in the passenger compartment only when the difference between the first and second amplitudes is less than a threshold.

Another aspect of the disclosure includes the first and second frequencies being determined based upon rotational speeds of the first and second torque machines, respectively.

Another aspect of the disclosure includes the first and second amplitudes being determined based upon torque outputs from the first and second torque machines, respectively.

Another aspect of the disclosure includes monitoring a rotational speed associated with the first torque machine, and controlling the audio speaker to generate the correction tone based upon the first parameters, the second parameters and the desired audible sound in the passenger compartment only when the rotational speed is greater than a minimum threshold speed.

Another aspect of the disclosure includes monitoring a load associated with the first torque machine, and controlling the audio speaker to generate the correction tone based upon the first parameters, the second parameters and the desired audible sound in the passenger compartment only when the load is greater than a minimum threshold load.

Another aspect of the disclosure includes the desired audible sound having a desired frequency that is a numerical average of the first frequency and the second frequency.

Another aspect of the disclosure includes the desired audible sound having a desired frequency that is a less than the first frequency and is within a critical band associated with the first and second frequencies.

Another aspect of the disclosure includes the desired audible sound having a first desired frequency and a second desired frequency, wherein the first desired frequency is less than the first frequency and the second desired frequency is greater than the second frequency.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which:

FIG. 4-1 graphically shows an example of an objectionable sound in context of sound frequency, wherein magnitude of audible sound (dB) is plotted in relation to the frequency spectrum (Hz), in accordance with the disclosure;

FIG. 4-2 graphically shows the example of the objectionable sound and a first correction tone in context of sound frequency, wherein magnitude of audible sound (dB) is plotted in relation to the frequency spectrum (Hz), in accordance with the disclosure; and, FIG. 4-3 graphically shows the example of the objectionable sound and first and second correction tones in context of sound frequency, wherein magnitude of audible sound (dB) is plotted in relation to the frequency spectrum (Hz), in accordance with the disclosure;

The appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the drawings are in simplified form and are not to precise scale. For purposes of convenience and clarity, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein.

Figure 1:
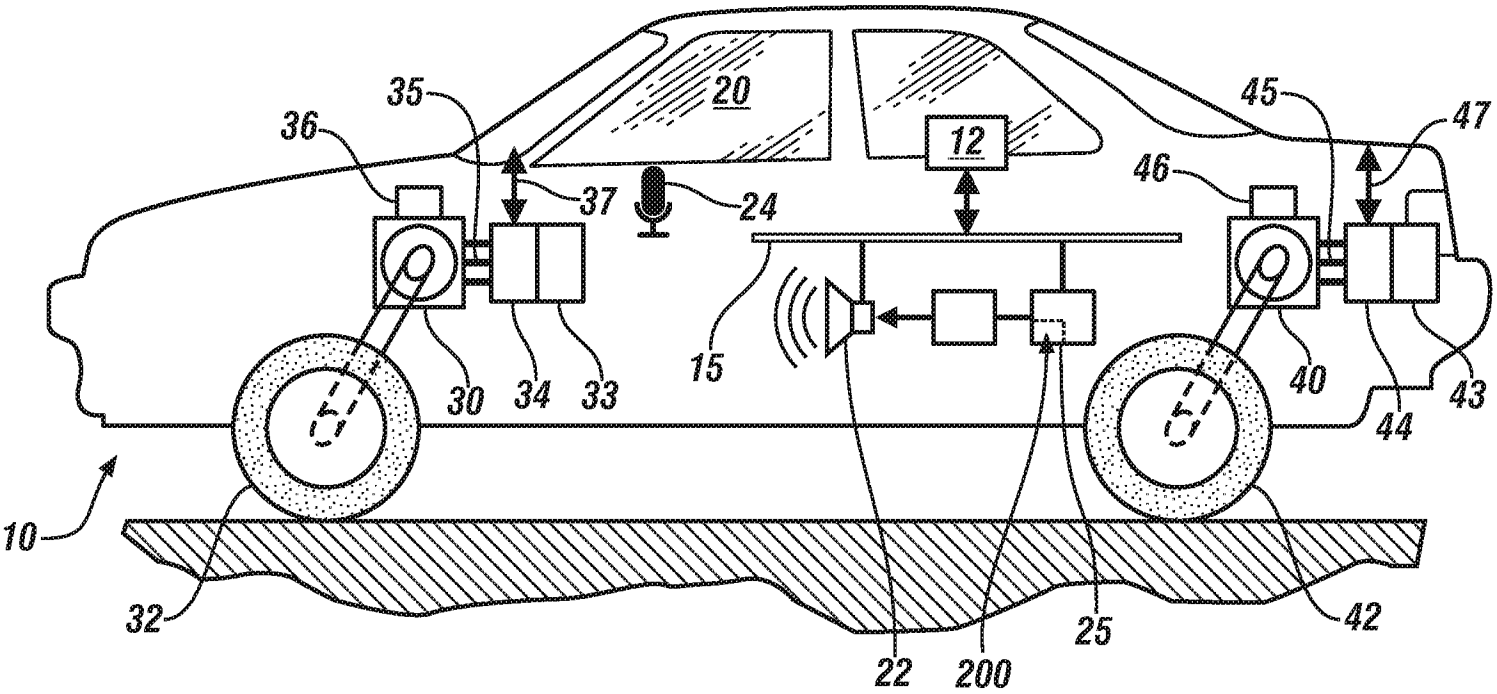
FIG. 1 schematically shows a side-view of a vehicle that is composed of a passenger compartment, a first torque machine and a second torque machine, wherein the first and second torque machines may at times operate at similar speed and load targets to accomplish similar vehicle functions, in accordance with the disclosure.

Referring to the drawings, wherein like reference numerals correspond to like or similar components throughout the several Figures, FIG. 1, consistent with embodiments disclosed herein, schematically illustrates a side-view of a vehicle 10. The vehicle may include, but not be limited to a mobile platform in the form of a commercial vehicle, industrial vehicle, agricultural vehicle, passenger vehicle, aircraft, watercraft, train, all-terrain vehicle, personal movement apparatus, robot and the like to accomplish the purposes of this disclosure.

The vehicle 10 is composed of a passenger compartment 20, a first torque machine 30 and a second torque machine 40, wherein the first and second torque machines 30, 40 may at times operate at similar speed and load targets, and in one embodiment may operate to accomplish similar system or vehicle functions. Similar functions include, by way of example, vehicle tractive torque effort, operation of multiple electric cooling fans, and operation of multiple turbochargers or superchargers. As used herein, the term "torque machine" refers to a device that is configured to transform potential energy to motive torque. In one embodiment, the first and second torque machines 30, 40 are multi-phase electric machines that operate as motor/generator devices to convert electric power to mechanical effort and vice-versa. Alternatively, the first and second torque machines 30, 40 can be configured as pneumatic machines. Alternatively, the first and second torque machines 30, 40 can be configured as hydraulic machines. In one embodiment, and as shown, the first and second torque machines 30, 40 are employed as prime movers, with front wheels 32 being rotatably coupled to the first torque machine 30, and rear wheels 42 being rotatably coupled to the second torque machine 40. Alternatively, the first torque machine 30 may be rotatably coupled to a leftward one of the front (or rear) wheels, and the second torque machine 40 may be rotatably coupled to a rightward one of the front (or rear) wheels. Alternatively, the first and second torque machines 30, 40 are employed as accessory drivers, e.g., as motors that are rotatably coupled to first and second fans that are part of a cooling system for an internal combustion engine. Alternatively, the first and second torque machines 30, 40 are employed as accessory drivers, e.g., as motors that are rotatably coupled to first and second superchargers that are part of an internal combustion engine air intake system.

The passenger compartment 20 includes passenger seating devices, an audio speaker 22, and a microphone 24. In one embodiment, the audio speaker 22 and microphone 24 are in communication with an infotainment system 25.

The first torque machine 30, when configured as a multi-phase electric machine, is electrically connected to a first inverter 34 and first inverter controller 33. The first inverter 34 is configured to transform DC electrical power originating from a DC power source to first pulsewidth-modulated (PWM) signals 35 to urge rotation of a rotor of the first torque machine 30 to rotate the front wheel(s) 32 for tractive effort. As appreciated, the tractive effort can be in either a forward direction (acceleration) or a reverse direction (braking) as applied to the front wheel(s) 32 in context of movement of the vehicle 10. Parameters associated with operation of the first torque machine 30 and first inverter 34 may be monitored. This may include, by way of non-limiting examples, monitoring signals from an accelerometer 36 and sensors and systems that monitor rotational position/speed, torque, electrical current, and the first PWM signals 35. The parameters associated with operation of the first torque machine 30 and first inverter 34 are indicated by numeral 37, and may be communicated to the first inverter controller 33 in one embodiment.

The second torque machine 40, when configured as a multi-phase electric machine, is electrically connected to a second inverter 44 and second inverter controller 43. The second inverter 44 is configured to transform DC electrical power originating from the DC power source to second pulsewidth-modulated (PWM) signals 45 to urge rotation of a rotor of the second torque machine 40 to rotate the rear wheel(s) 42 for tractive effort. As appreciated, the tractive effort can be in either a forward direction (acceleration) or a reverse direction (braking) as applied to the rear wheel(s) 42 in context of movement of the vehicle 10. Parameters associated with operation of the second torque machine 40 and second inverter 44 may be monitored. This may include, by way of non-limiting examples, monitoring signals from an accelerometer and sensors and systems that monitor rotational position/speed, torque, electrical current, and the second PWM signals 45. The parameters associated with operation of the second torque machine 40 and second inverter 44 and are indicated by numeral 47.

A controller 12 is in communication with the first and second inverter controllers 33, 43, and the infotainment system 25, either directly or via a communication link 15.

The term "controller" and related terms such as control module, module, control, control unit, processor and similar terms refer to one or various combinations of Application Specific Integrated Circuit(s) (ASIC), electronic circuit(s), central processing unit(s), e.g., microprocessor(s) and associated non-transitory memory component(s) in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning and buffer circuitry and other components that can be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms and similar terms mean controller-executable instruction sets including calibrations and look-up tables. Each controller executes control routine(s) to provide desired functions. Routines may be executed at regular intervals, for example each 100 microseconds during ongoing operation. Alternatively, routines may be executed in response to occurrence of a triggering event. Communication between controllers, and communication between controllers, actuators and/or sensors may be accomplished using a direct wired point-to-point link, a networked communication bus link, a wireless link or another suitable communication link, and is indicated by line 15. Communication includes exchanging data signals in suitable form, including, for example, electrical signals via a conductive medium, electromagnetic signals via air, optical signals via optical waveguides, and the like. The data signals may include discrete, analog or digitized analog signals representing inputs from sensors, actuator commands, and communication between controllers. The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium.

The term 'model' refers to a processor-based or processor-executable code and associated calibration that simulates a physical existence of a device or a physical process. As used herein, the terms 'dynamic' and 'dynamically' describe steps or processes that are executed in real-time and are characterized by monitoring or otherwise determining states of parameters and regularly or periodically updating the states of the parameters during execution of a routine or between iterations of execution of the routine. The terms "calibration", "calibrate", and related terms refer to a result or a process that compares an actual or standard measurement associated with a device with a perceived or observed measurement or a commanded position. A calibration as described herein can be reduced to a storable parametric table, a plurality of executable equations or another suitable form. A parameter is defined as a measurable quantity that represents a physical property of a device or other element that is discernible using one or more sensors and/or a physical model. A parameter can have a discrete value, e.g., either "1" or "0", or can be infinitely variable in value.

When the first and second torque machines 30, 40 of the vehicle 10 are operating at or near the same speed and load operating points, such as when operating to accomplish similar system or vehicle functions, they may generate beating, booming, and/or another modulation tonal noise that is caused by interactions in tonal sinewaves that are emitted from each of the first and second torque machines 30, 40 that unintentionally combine in the passenger compartment 20 and may become objectionable to passengers.

Figure 2:
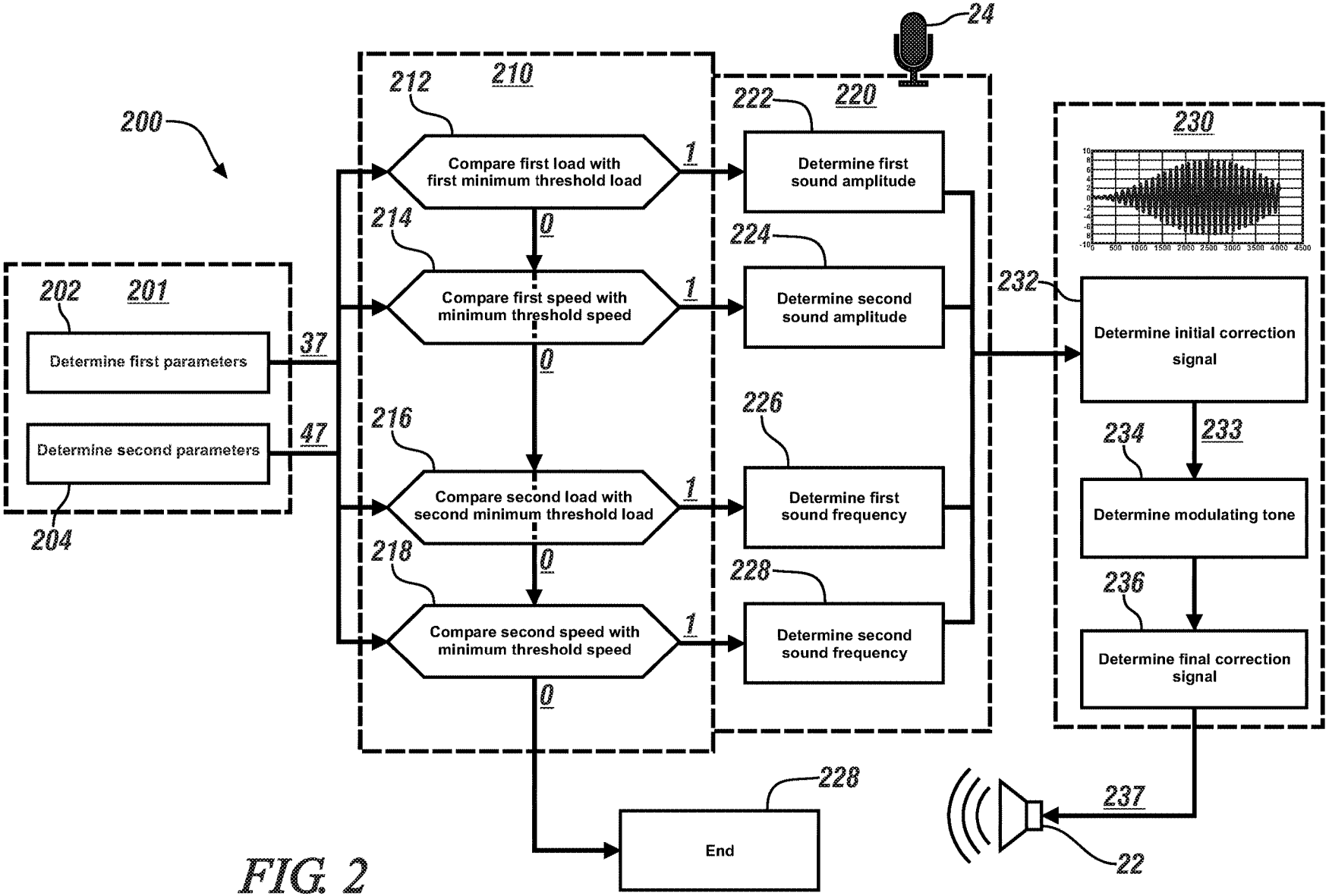
FIG. 2 schematically shows a motor noise mitigation process for advantageously augmenting modulating tones that are caused by interactions in tonal sinewaves that are emitted from each of the first and second torque machines when they are operating at similar speed and load targets such as when operating to accomplish similar vehicle functions, in accordance with the disclosure.

FIG. 2 schematically shows a motor noise mitigation process 200 for advantageously augmenting, mitigating or otherwise counteracting objectionable modulating tones that are caused by interactions in tonal sinewaves that are emitted from each of the first and second torque machines 30, 40 when they are operating at similar speed and load targets such as when operating to accomplish similar system or vehicle functions. The teachings may be described herein in terms of functional and/or logical block components and/or various processing steps. It should be realized that such block components may be composed of hardware, software, and/or firmware components that have been configured to perform the specified functions.

The motor noise mitigation process 200 is described in context of the vehicle 10 that is described with reference to FIG. 1, although it is appreciated that the concepts described herein are applicable to a variety of similarly situated systems. The motor noise mitigation process 200 can be reduced to practice as one or a plurality of algorithms and formed into an encoded datafile that is stored in a non-transitory digital data storage medium, including a memory device that is readable by the controller 12 of the vehicle 10. The motor noise mitigation process 200 is dynamically executable by the controller 12 to augment or otherwise mitigate one or more modulating tones that form objectionable sounds that are discernible in an embodiment of the passenger compartment 20 of the vehicle 10. As employed herein, the term "1" indicates an answer in the affirmative, or "YES", and the term "0" indicates an answer in the negative, or "NO".

The motor noise mitigation process 200 includes monitoring operation of the first and second torque machines 30, 40 (201), including dynamically monitoring to determine the first parameters 37 that are associated with operation of the first electric machine 30 (202), and determine the second parameters 47 that are associated with operation of the second electric machine 40 (204). The first and second parameters 37, 47 include respective rotational speeds and loads of the first and second torque machines 30, 40, and respective frequencies, amplitudes and phases of audible tones generated thereby.

The respective speeds and loads of the first and second torque machines 30, 40 are evaluated to determine whether they are of magnitudes that are sufficient to generate objectionable sound in the passenger compartment 20 of the vehicle 10 (210). This includes comparing the load associated with operation of the first torque machine 30 with a first minimum threshold load (212), and comparing the speed associated with operation of the first torque machine 30 with a minimum threshold speed (214). This also includes comparing the load associated with operation of the second torque machine 40 with the first minimum threshold load (216), and comparing the speed associated with operation of the second torque machine 40 with the minimum threshold speed (218).

When either the speed or load associated with operation of either the first or the second torque machine 30, 40 is less than the corresponding minimum threshold speed or load (212)(0), (214)(0), (216)(0) and (218)(0), this iteration of the motor noise mitigation routine ends (219). This decision may be based upon whether the combination of tones generated by the first and second torque machines 30, 40 results in a modulating tone that is of great enough magnitude to be objectionable, or whether the frequency spectrum of the combination of tones is sufficiently divergent to avoid generating a monotone. The modulating tones caused by rotation of the rotating components of the first and second torque machines 30, 40 may have the same frequency as the respective rotational speed of the first or second torque machine 30, 40 in one embodiment. The modulating tones caused by rotation of the rotating components of the first and second torque machines 30, 40 may have a frequency that is a scalar multiple of the respective rotational speed of the first or second torque machine 30, 40 in one embodiment. This may occur when the predominant source of the modulating tone is generated by a rotatable element attached to the respective torque machine, such as a cooling fan having an associated quantity of fins, or a gearset having an associated quantity of gear teeth. Furthermore, noise radiated from a gearset may be related to tooth cut, tooth finish, manufacturing tolerances and other factors that may cause some misalignment under load. By way of example, suboptimal meshing under load may generate a tonal disturbance, and when two torque machines are operating simultaneously, their tonal disturbances may cause a modulating tone that is of great enough magnitude to be objectionable.

When all of the speed and load terms associated with operation of the first and the second torque machines 30, 40, are greater than the corresponding minimum threshold speed and load (212)(1), (214)(1), (216)(1) and (218)(1), this is an indication that the speeds and loads of the first and second torque machines 30, 40 are of magnitudes that are sufficient to potentially generate a modulating tone that is objectionable in the passenger compartment 20 of the vehicle 10, and execution of the motor noise mitigation process 200 proceeds to the next steps.

The following relationship can be employed to determine whether the speeds and loads of the first and second torque machines 30, 40 are of magnitudes that are sufficient to potentially generate a modulating tone that is associated with objectionable sound in the passenger compartment 20 of the vehicle 10, i.e., step 210 of FIG. 2.

Specifically, the speeds and loads of the first and second torque machines 30, 40 may be of magnitudes that are sufficient to generate a modulating tone that is associated with objectionable sound in the passenger compartment 20 of the vehicle 10 under the following conditions:

$$\text{abs}(F1-F2)<F\text{thresh AND}$$

$$\text{abs}(A1-A2)<A\text{thresh}$$

wherein:

Fthresh is a threshold to determine if the frequencies of the rotating components of the first and second torque machines 30, 40 are close enough to generate the modulating tone; and Athresh is a threshold to determine if the amplitudes of the rotating components of the first and second torque machines 30, 40 are close enough to generate the modulating tone.

The frequency threshold Fthresh and the amplitude threshold Athresh may be vehicle-specific parameters that are determined via on-vehicle testing and/or simulation. In one embodiment, the frequency threshold Fthresh and the amplitude threshold Athresh are selected based upon a tone-to-noise ratio (TTNR), which is defined as a power of a tone as compared to noise power of a critical frequency band surrounding the tone. A tone may be considered prominent, and thus undesirable, when the TTNR is at least 8 dB within a critical frequency band in one embodiment. Critical frequency bands, or critical bands, are concepts that are associated with acoustic sound.

The next steps, shown with reference to element 220, include determining an amplitude of the sound generated by the first torque machine 30 (222), determining an amplitude of the sound generated by the second torque machine 40 (224), determining a frequency of the sound generated by the first torque machine 30 (226), and determining a frequency of the sound generated by the second torque machine 40 (228). This may be accomplished by direct measurement, inferred measurement based upon commanded operation and precalibrated parameters, or direct or inferred measurement with feedback from the microphone 24 to verify the magnitudes thereof.

The initial correction signal 233 is transformed to a final correction signal 237 that is communicated to the infotainment system 25 (230). The first parameters 37 associated with audible sound that is generated by operation of the first torque machine 30 and the second parameters 47 associated with audible sound that is generated by operation of the second electric machine 40 are evaluated to determine an initial correction signal 233, which has a frequency and amplitude fluctuation, e.g., as depicted in element 230. The initial correction signal 233 may be complementary to the modulating tone that is formed by interaction of the audible sounds that are generated by the first and second torque machines 30, 40. The infotainment system 25 controls the speaker 22 to generate the final correction signal 237 in the passenger compartment 20 to augment the modulating tone, resulting in the desired audible sound. Non-limiting examples of a modulating tone, a desired audible sound, and a correction tone are shown with reference to FIG. 3. As such, when it is determined that there is a potential that objectionable sound may be generated by operation of the first and second torque machines 30, 40, the audio speaker 22 is controlled by the infotainment system 25 to generate the final correction signal 237 in the passenger compartment 20, with the sound being based upon the first parameters 37, the second parameters 47 and the desired audible sound for the passenger compartment 20 (232, 234, 236).

Figure 3:
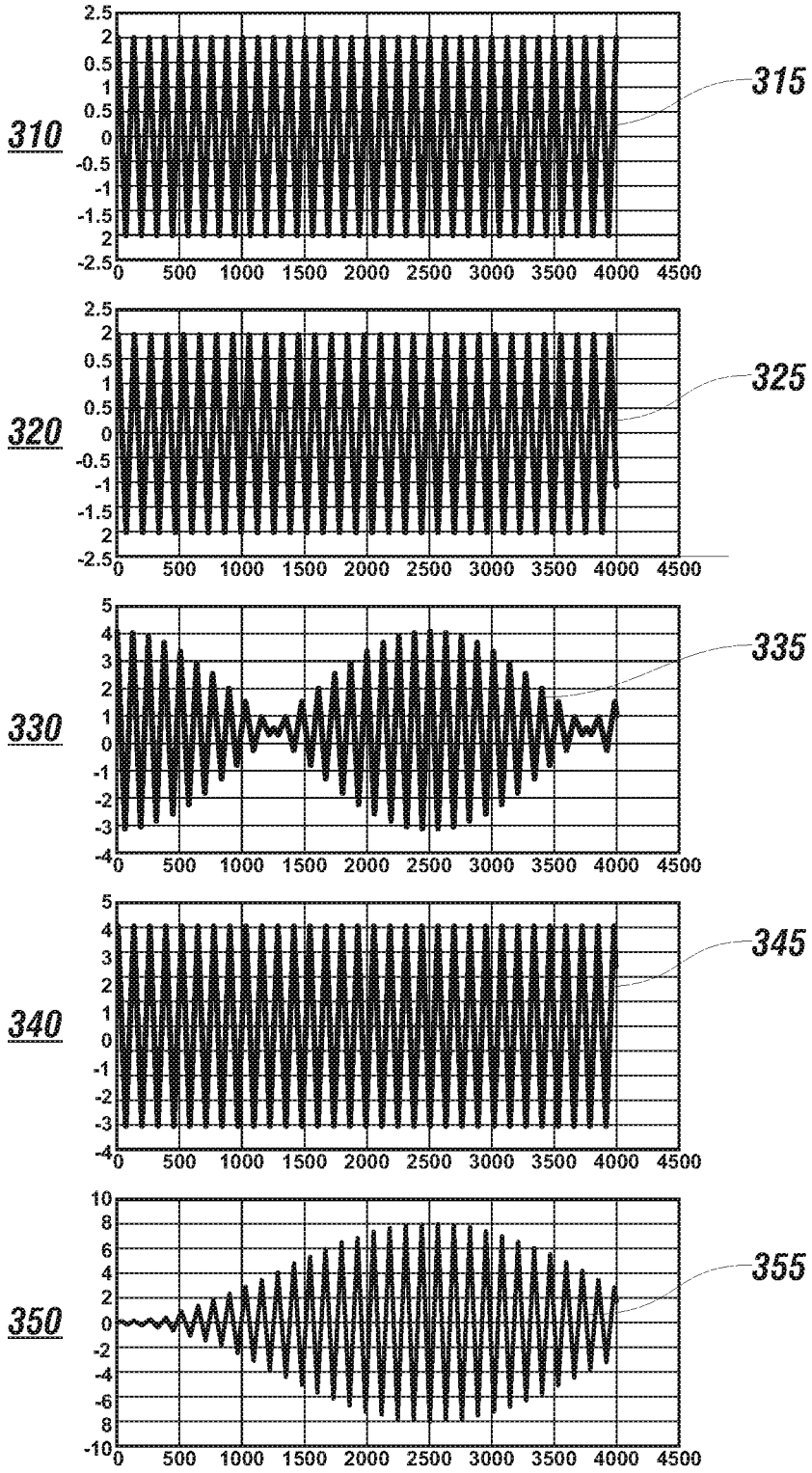
FIG. 3 graphically shows non-limiting examples of coincidentally occurring sound waves that are associated with determining a correction signal based upon first parameters associated with audible sound that is generated by operation of the first torque machine and second parameters associated with audible sound that is generated by operation of the second torque machine during operation of the vehicle, in accordance with the disclosure.

FIG. 3 graphically shows non-limiting examples of time-coincident sound waves that are associated with determining the correction signal 237 based upon the first parameters 37 associated with audible sound that is generated by operation of the first torque machine 30 and the second parameters 47 associated with audible sound that is generated by operation of the second electric machine 40 during operation of the vehicle 10. The sound waves are coincident, with sound intensity (dB) plotted on each respective vertical axis in relation to elapsed time, which is on the horizontal axis.

First graph 310 depicts an example of a first tone 315 that is generated by the first torque machine 30 at a predetermined operating state, which can be characterized as having a frequency of 200 Hz and an amplitude of 2 db.

Second graph 320 depicts an example of a second tone 325 that is generated by the second torque machine 40 at a predetermined operating state, which can be characterized as having a frequency of 190 Hz and an amplitude of 2 db.

Third graph 330 depicts an example of a modulating tone 335, which is formed by a combination of the first and second tones 315, 325 and resulting in a beating sound that may be objectionable due to the aforementioned combination, i.e., the objectionable sound that is described herein.

Fourth graph 340 depicts one embodiment of a desired audible sound 345, which is a plain tone characterized by a center frequency waveform that is capable of augmenting the first and second tones 315, 325.

Fifth graph 350 is the correction tone 355, which is generated by the infotainment system 25 via the audio speaker 22 to augment the first and second tones 315, 325, with a resultant being the desired audible sound 345, e.g., a plain tone.

Figures 1, 4:
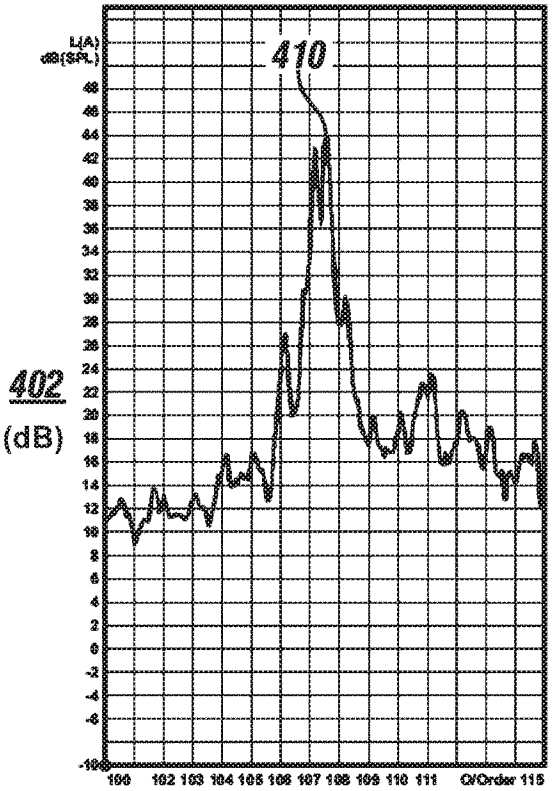
Figures 2, 4:
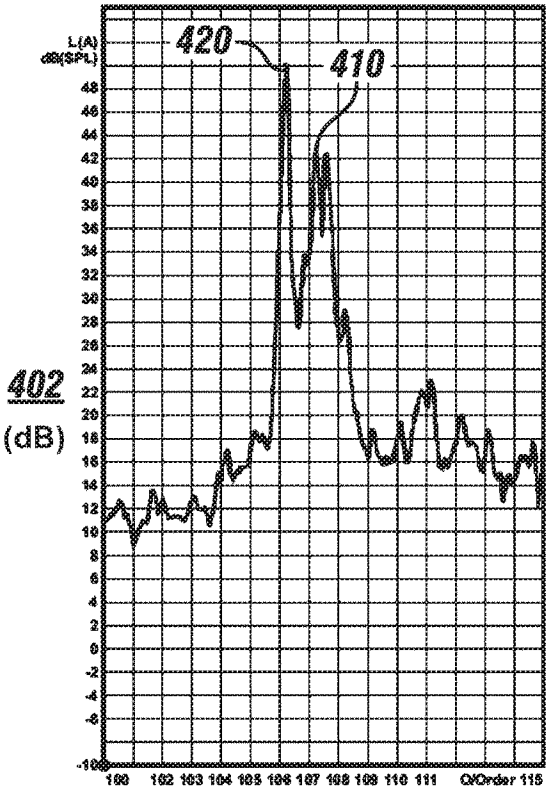
Figures 3, 4:
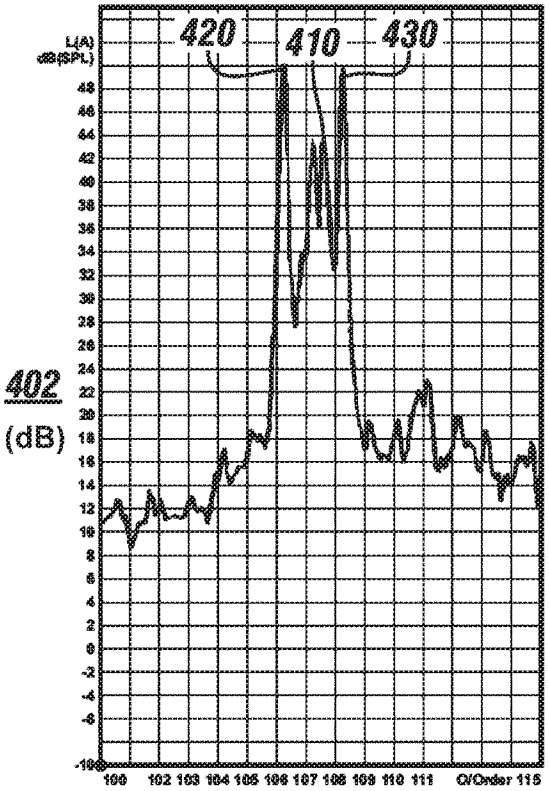

FIG. 4-1 graphically shows an example of an objectionable sound 410 in context of sound frequency, wherein magnitude of audible sound (dB) 402 is plotted on the vertical axis in relation to the frequency spectrum (Hz) 404, which is plotted on the horizontal axis.

FIG. 4-2 graphically shows the example of the objectionable sound 410 and a first correction tone 420 that is generated at a lower frequency, in context of sound frequency, wherein magnitude of audible sound (dB) 402 is plotted on the vertical axis in relation to the frequency spectrum (Hz) 404, which is plotted on the horizontal axis.

FIG. 4-3 graphically shows the example of the objectionable sound 410, a first correction tone 420 that is generated at a lower frequency and a second correction tone 430 that is generated at a higher frequency, in context of sound frequency, wherein magnitude of audible sound (dB) 402 is plotted in relation to the frequency spectrum (Hz) 404.

The process of augmenting the first and second tones 315, 325 is described analytically as follows, with continued reference to FIGS. 1, 2 and 3. Each of the first and second tones 315, 325 and the resulting desired audible sound 345 are characterized in terms of amplitude, frequency and phase. The amplitude generally corresponds to torque output from the associated torque machine and the frequency generally corresponds to rotational speed of the associated torque machine. The phase term relates to a time alignment of the first and second tones 315, 325 and the resulting desired audible sound 345, and is relevant to maximizing effectiveness of the desired audible sound 345.

The first tone 315 that is generated by operation of the first torque machine 30 can be characterized by the following equation:

$$y1=A1*\cos(2\pi*F1*t+\phi1) \quad [1]$$

wherein:

y1 is the time signal representing the sound generated by the first torque machine 30, A1 is the amplitude of the sound of the first torque machine 30, F1 is the frequency of the sound of the first torque machine 30, ϕ1 is the phase of the sound of the first torque machine 30, and t is time.

The frequency F1 and phase ϕ1 may be derived from the parameters 37 associated with operation of the first torque machine 30 and first inverter 34, and can be inferred from a command, or measured employing the accelerometer 36 or a rotational position sensor. The amplitude A1 can be obtained from the accelerometer 36 or magnitude of torque generated by the first torque machine 30.

The second tone 325 that is generated by operation of the second torque machine 40 can be characterized by the following equation:

$$y2=A2*\cos(2\pi*F2*t+\phi2) \quad [2]$$

wherein:

y2 is the time signal representing the sound generated by the second torque machine 40, A2 is the amplitude of the sound of the second torque machine 40, F2 is the frequency of the sound of the second torque machine 40, ϕ2 is the phase of the sound of the second torque machine 40, and t is time.

Again, the frequency F2 and phase ϕ2 may be derived from the parameters 47 associated with operation of the second torque machine 40 and second inverter 44, and can be inferred from a command, or measured employing the accelerometer 46 or a rotational position sensor. The amplitude A2 can be obtained from the accelerometer 46 or magnitude of torque generated by the second torque machine 40.

The modulating tone 335, which is a combination of the first and second tones 315, 325, results in a beating sound that may be objectionable due to the combination thereof, and may be characterized by the following equation:

$$\text{Beating}=y1+y2 \quad [3]$$

A frequency for the correction tone 355 to generate the desired audible sound to augment the first and second tones 315, 325 may be determined as follows:

$$F3=(F1+F2)/2 \quad [4]$$

wherein:

F3 is the frequency of the desired audible sound.

The frequency F3 of the desired audible sound may be a specific center frequency that is selected to augment the effect of the first and second tones 315, 325. Alternatively, the desired audible sound may be constructed as a nominally cosine wave that counteracts the nominally sine waves of the first and second tones 315, 325.

Alternatively, the frequency F3 of the desired audible sound may be a specific desired frequency that is less than either F1 or F2 and still within a critical band that is associated with F1 and F2, and is selected to mask the effect of the first and second tones 315, 325. FIG. 4-2 graphically shows an example of the frequency F3 of the desired audible sound, i.e., first correction tone 420, which is at a specific desired frequency that is less than either F1 or F2, and is at a magnitude that is equal to or in the same order of magnitude of as the objectionable sound 410, and is still within a critical band that is associated with F1 and F2.

Alternatively, the desired audible sound may be composed of multiple desired audible sounds, wherein at least one of the multiple desired audible sounds may be at a first desired frequency F3-Low that is less than either F1 or F2 and still within a critical band that is associated with F1 and F2, and at least one of the multiple desired audible sounds may be at a second desired frequency F3-Low that is greater than either F1 or F2 and still within the critical band that is associated with F1 and F2, wherein the first and second desired frequencies F3-Low, F3-High are selected to mask the effect of the first and second tones 315, 325. FIG. 4-3 graphically shows an example of the frequency F3-Low of the desired audible sound, i.e., first correction tone 420, and an example of the frequency F3-High of the desired audible sound, i.e., second correction tone 430. The first correction tone 420 is at a specific desired frequency that is less than either F1 or F2 and still within a critical band that is associated with F1 and F2, and the second correction tone 430 is at a specific desired frequency that is greater than either F1 or F2 and still within the critical band that is associated with F1 and F2. Both the first correction tone 420 and second correction tone 430 are at magnitudes that are equal to or in the same order of magnitude of as the objectionable sound 410.

An amplitude for the correction tone 355 to generate the desired audible sound to augment the first and second tones 315, 325 may be determined as follows:

$$A3=A1+A2 \quad [5]$$

wherein:

A3 is the amplitude of the desired audible sound to be heard.

The desired audible sound 345 can be characterized by the following equation:

$$y3=A3+A3\text{delta}*\cos(2\pi*F3+F3\text{delta}*t+t\text{delta}+\text{phi}3) \quad [6]$$

wherein:

y3 is the time signal representing the desired audible sound to be heard,

A3 is the amplitude of the desired audible sound to be heard,

A3delta is an amplitude correction if appropriate,

F3 is the frequency of the desired audible sound to be heard,

F3delta is a frequency correction if appropriate,

Phi3 is the phase of the desired audible sound to be heard, t is time, and tdelta is a time correction when appropriate.

The correction tone 355 can be determined as follows:

$$\text{Correction Tone}=y3-\text{Beating} \quad [7]$$

wherein the Correction Tone is the correction tone 355 that is played by the speaker 22 to augment the modulating tone 335.

Latencies may be introduced into the system, including latencies associated with signal processing related to capturing measurement signals associated with the first and second parameters 37, 47, effecting communications, executing processing algorithms, and communicating control signals to actuators such as the speaker 22. Such latencies may result in a time delay between an observed operation of one of the torque machines and the resultant generation of a correction tone that is associated with the observed operation. Total latency may be on the order of magnitude of 3 ms to 15 ms. However, the latency time is determinative and predictable. As such, a prediction algorithm can be employed to adapt the correction signal based upon the latencies. Other parameters that support the prediction algorithm may include output torques from the torque machines, an output torque request, as input from a brake pedal, an accelerator pedal, and/or a cruise control command, time-based derivatives of the elements of the output torque request, rotational speeds of the torque machines. The prediction algorithm can be employed to calculate the amplitude correction A3delta, frequency correction F3delta, and time correction tdelta.

Furthermore the frequency and phase of audible sound from either of the first and second torque machines 30, 40 are as accurate as the monitoring sensors and associated signal processing devices. The amplitude of the audible sound from either of the first and second torque machines 30, 40 is expected to be the highest source of error based on the estimation(s). Therefore the amplitude of the correction tone will be the largest expected error. By monitoring the sound heard inside the vehicle 10 via the microphone 24 and comparing with the desired audible sound, an error in amplitude can be estimated used to determine amplitude correction A3delta.

In one embodiment, phase may be determined by utilizing signal outputs from the first and second accelerometers 36, 46, or from rotational position sensors. The signal outputs from the first and second accelerometers 36, 46, measure the actual output of speed, amplitude and phase, with the phase being determined by utilizing the time signal and/or calculating a Fourier transform (FFT) of the signal outputs from the first and second accelerometers 36, 46.

As such, a method, implementable in an embodiment of the vehicle 10 that is described with reference to FIG. 1, operates to determine a tonal frequency and associated amplitude for a correction tone that augments a modulating tone, wherein the modulating tone be an objectionable beating sound that is a combination of first and second tones that are generated by first and second torque machines, respectively. By monitoring signals from the first and second torque machines, a desired frequency and amplitude can be determined and applied. This includes adding higher amplitude tone(s) at a set frequency(s) away from the offending modulating tone, or calculating a complementary tone to augment the modulating tone.

The flowchart and block diagrams in the flow diagrams illustrate the architecture, functionality, and operation of possible implementations of systems, methods, and computer program products according to various embodiments of the present disclosure. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a controller or other programmable data processing apparatus to function in a particular manner, such that the instructions stored in the computer-readable medium produce an article of manufacture including instructions to implement the function/act specified in the flowchart and/or block diagram block or blocks.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. A vehicle, comprising:

a passenger compartment including a controllable audio speaker;

a first torque machine and a second torque machine;

a controller, in communication with the first and second torque machines and the audio speaker, the controller including an instruction set, the instruction set executable to:

determine first parameters associated with a first audible sound generated by operation of the first torque machine, wherein the first parameters associated with the first audible sound generated by operation of the first torque machine include a first frequency, a first amplitude and a first phase, determine second parameters associated with a second audible sound generated by operation of the second torque machine, wherein the second parameters associated with the second audible sound generated by operation of the second torque machine include a second frequency, a second amplitude and a second phase, determine a desired audible sound in the passenger compartment based upon the first and second audible sounds, determine a difference between the first frequency associated with the first audible sound and the second frequency associated with the second audible sound, control the audio speaker to generate a correction tone based upon the first parameters, the second parameters and the desired audible sound in the passenger compartment, and control the audio speaker to generate the correction tone based upon the first parameters, the second parameters and the desired audible sound in the passenger compartment only when the difference between the first and second frequencies is less than a threshold.

2. The vehicle of claim 1, further comprising the instruction set executable to: determine a difference between the first amplitude associated with the first torque machine and the second amplitude associated with the second torque machine, and control the audio speaker to generate the correction tone based upon the first parameters, the second parameters and the desired audible sound in the passenger compartment only when the difference between the first and second amplitudes is less than a threshold.

3. The vehicle of claim 1, further comprising the instruction set executable to: determine the first amplitude associated with the first torque machine and the second amplitude associated with the second torque machine, and control the audio speaker to generate the correction tone based upon the first parameters, the second parameters and the desired audible sound in the passenger compartment only when the first and second amplitudes are both greater than a threshold.

4. The vehicle of claim 1, wherein the first and second frequencies are determined based upon rotational speeds of the first and second torque machines, respectively.

5. The vehicle of claim 1, wherein the first and second amplitudes are determined based upon torque outputs from the first and second torque machines, respectively.

6. The vehicle of claim 1, further comprising the instruction set executable to monitor a rotational speed associated with the first torque machine, and control the audio speaker to generate the correction tone based upon the first parameters, the second parameters and the desired audible sound in the passenger compartment only when the rotational speed is greater than a minimum threshold speed.

7. The vehicle of claim 1, further comprising the instruction set executable to monitor a load associated with the first torque machine, and control the audio speaker to generate the correction tone based upon the first parameters, the second parameters and the desired audible sound in the passenger compartment only when the load is greater than a minimum threshold load.

8. A method for augmenting audible sound in a passenger compartment of a vehicle, wherein the vehicle includes a first electric machine and a second electric machine and wherein the passenger compartment includes a controllable audio speaker, the method comprising:

determining first parameters associated with a first audible sound generated by operation of the first electric machine, wherein the first parameters associated with the first audible sound generated by operation of the first electric machine comprise a first frequency, a first amplitude and a first phase;

determining second parameters associated with a second audible sound generated by operation of the second electric machine, wherein the second parameters associated with the second audible sound generated by operation of the second electric machine comprise a second frequency, a second amplitude and a second phase;

determining a desired audible sound in the passenger compartment based upon the first and second audible sounds, determining a difference between the first frequency associated with the first audible sound and the second frequency associated with the second audible sound, controlling the audio speaker to generate a correction tone based upon the first parameters, the second parameters and the desired audible sound in the passenger compartment, and controlling the audio speaker to generate the correction tone based upon the first parameters, the second parameters and the desired audible sound in the passenger compartment only when the difference between the first and second frequencies is less than a threshold.

9. The method of claim 8, further comprising: determining a difference between the first amplitude associated with the first electric machine and the second amplitude associated with the second electric machine, and controlling the audio speaker to generate the correction tone based upon the first parameters, the second parameters and the desired audible sound in the passenger compartment only when the difference between the first and second amplitudes is less than a threshold.

10. The method of claim 8, wherein the first and second frequencies are correlated to rotational speeds of the first and second electric machines, respectively, and wherein the first and second amplitudes are determined based upon torque outputs from the first and second electric machines, respectively.

11. The method of claim 8, wherein the desired audible sound has a desired frequency that is a numerical average of the first frequency and the second frequency.

12. The method of claim 8, wherein the desired audible sound has a desired frequency that is a less than the first frequency and is within a critical band associated with the first and second frequencies.

13. The method of claim 8, wherein the desired audible sound includes a first desired frequency and a second desired frequency, wherein the first desired frequency is less than the first frequency and the second desired frequency is greater than the second frequency.

14. The method of claim 8, further comprising monitoring a rotational speed associated with the first electric machine, and controlling the audio speaker to generate the correction tone based upon the first parameters, the second parameters and the desired audible sound in the passenger compartment only when the rotational speed is greater than a minimum threshold speed.

15. The method of claim 8, further comprising monitoring a load associated with the first electric machine, and controlling the audio speaker to generate the correction tone based upon the first parameters, the second parameters and the desired audible sound in the passenger compartment only when the load is greater than a minimum threshold load.

16. A vehicle, comprising:

a passenger compartment including a controllable audio speaker;

a first torque machine and a second torque machine;

a controller, in communication with the first and second torque machines and the audio speaker, the controller including an instruction set, the instruction set executable to:

determine first parameters associated with a first audible sound generated by operation of the first torque machine, determine second parameters associated with a second audible sound generated by operation of the second torque machine, determine a modulating sound based upon a combination of the first and second audible sounds;

determine a desired audible sound in the passenger compartment based upon the modulating sound, and control the audio speaker to generate a correction tone to augment the modulating sound, wherein the correction tone is generated based upon the first parameters, the second parameters and the desired audible sound in the passenger compartment.

* * * * *